US011058178B2

(12) United States Patent
Chang

(10) Patent No.: US 11,058,178 B2
(45) **Date of Patent: *Jul. 13, 2021**

(54) MOISTURE-PERMEABLE WATERPROOF SHOE HAVING AN UPRIGHT VELVET INNER SLEEVE

(71) Applicant: SHUANG BANG INDUSTRIAL CORP., Nantou (TW)

(72) Inventor: Chung-Tang Chang, Nantou (TW)

(73) Assignee: SHUANG BANG INDUSTRIAL CORP., Nantou (TW)

( * ) Notice: Subject to any disclaimer, the term of this patent is extended or adjusted under 35 U.S.C. 154(b) by 105 days.

This patent is subject to a terminal disclaimer.

(21) Appl. No.: 16/532,983

(22) Filed: Aug. 6, 2019

(65) Prior Publication Data

US 2020/0214393 A1 Jul. 9, 2020

(30) Foreign Application Priority Data

Jan. 7, 2019 (TW) ..... 108100554

(51) Int. Cl.
*A43B 23/02* (2006.01)
*A43B 7/12* (2006.01)

(52) U.S. Cl.
CPC ..... *A43B 23/022* (2013.01); *A43B 7/12* (2013.01); *A43B 23/0235* (2013.01); *A43B 23/0245* (2013.01)

(58) Field of Classification Search
CPC ..... A43B 7/12; A43B 23/022; A43B 23/0235; A43B 23/026; A43B 23/025; A43B 23/07
USPC ..... 36/10, 55
See application file for complete search history.

(56) References Cited

U.S. PATENT DOCUMENTS

| | | | | | |
|---|---|---|---|---|---|
| 3,694,940 | A * | 10/1972 | Stohr | A43B 7/34 | 36/10 |
| 5,499,459 | A * | 3/1996 | Tomaro | A43B 1/0045 | 36/10 |
| 5,964,047 | A * | 10/1999 | Covatch | A43B 7/34 | 36/10 |
| 6,446,360 | B1 * | 9/2002 | Sheets | A43B 23/022 | 36/55 |
| 10,470,517 | B2 * | 11/2019 | Chang | A43B 13/32 | |
| 10,881,165 | B2 * | 1/2021 | Chang | A43B 7/125 | |
| 2002/0066212 | A1 * | 6/2002 | Pavelescu | A43B 7/125 | 36/55 |
| 2003/0061737 | A1 * | 4/2003 | Zhu | A43B 23/07 | 36/55 |
| 2005/0193592 | A1 * | 9/2005 | Dua | A43B 7/14 | 36/45 |

(Continued)

*Primary Examiner* — Marie D Bays
(74) *Attorney, Agent, or Firm* — Burris Law, PLLC

(57) ABSTRACT

A moisture-permeable waterproof shoe includes an upper defining an interior space, an inner sleeve inserted into the interior space and having a sleeve body made from a cut piece, and a sole fixed to a bottom portion of the upper. The cut piece includes an upright velvet layer having a plurality of pile yarns woven between a lining layer and an outer fabric layer of the cut piece, and has a main body with a front convex portion, and two wing portions each including a wing lateral edge connected to the wing lateral edge of the other wing portion, a front curved edge connected to a periphery of the front convex portion, and a rear mating edge connected to the rear mating edge of the other wing portion.

10 Claims, 13 Drawing Sheets

(56) References Cited

U.S. PATENT DOCUMENTS

| | | | | |
|---|---|---|---|---|
| 2015/0289592 | A1* | 10/2015 | Song | A43B 1/04 36/83 |
| 2018/0153257 | A1* | 6/2018 | Chang | A43C 11/14 |
| 2019/0223545 | A1* | 7/2019 | Chang | B32B 7/12 |
| 2019/0366680 | A1* | 12/2019 | Dua | A43B 1/04 |
| 2019/0387839 | A1* | 12/2019 | Dua | A43B 23/0205 |
| 2020/0214393 | A1* | 7/2020 | Chang | A43B 23/07 |
| 2020/0323304 | A1* | 10/2020 | Chang | A43B 23/04 |
| 2020/0405005 | A1* | 12/2020 | Chang | A43B 23/0235 |
| 2020/0405006 | A1* | 12/2020 | Chang | A43B 23/0245 |
| 2020/0405013 | A1* | 12/2020 | Chang | A43B 19/00 |

* cited by examiner

MOISTURE-PERMEABLE WATERPROOF SHOE HAVING AN UPRIGHT VELVET INNER SLEEVE

CROSS-REFERENCE TO RELATED APPLICATION

This application claims priority of Taiwanese Patent Application No. 108100554, filed on Jan. 7, 2019.

FIELD

The disclosure relates to a shoe, more particularly to a moisture-permeable waterproof shoe having an upright velvet inner sleeve.

BACKGROUND

An inner sleeve of a conventional moisture-permeable waterproof shoe is generally made by sewing together three cut pieces (e.g., left, right and bottom pieces). Each cut piece has a fabric lining, an outer fabric surface, and a foam layer fixed between the fabric lining and the outer fabric surface to form a sandwich structure. The inner sleeve can make use of the stiffness of the foam layers of the cut pieces to support its three-dimensional shape. However, the elasticity of the foam layers of the cut pieces is poor, so that it is difficult for a user to smoothly insert his/her foot into the inner sleeve when wearing the shoe. Moreover, the breathability of the foam layers of the cut pieces is also poor, so that it affects the comfort of the user when wearing the shoe. In addition, although the foam layers of the cut pieces are fixedly adhered between the fabric lining and the outer fabric surface using an adhesive, since the structures of the foam layers are inherently fragile, the foam layers are easily peeled off from the fabric lining or the outer fabric surface.

SUMMARY

Therefore, an object of the present disclosure is to provide a moisture-permeable waterproof shoe having an upright velvet inner sleeve that is capable of alleviating at least one of the drawbacks of the prior art.

Accordingly, a moisture-permeable waterproof shoe of this disclosure includes an upper defining an interior space, a shoe-shaped inner sleeve inserted into the interior space, a first adhesive layer, and a sole fixed to a bottom portion of the upper.

The inner sleeve includes a sleeve body defining a foot space and made from a cut piece which includes a fabric lining layer, an outer fabric layer and an upright velvet layer. The upright velvet layer has a plurality of spaced-apart pile yarns woven between the fabric lining layer and the outer fabric layer. The cut piece has a main body, and two wing portions symmetrically disposed on two opposite sides of the main body and integrally connected as one piece with the main body. The main body has a front convex portion and a rear concave portion opposite to the front convex portion. Each of the front convex portion and the rear concave portion has two opposite ends. Each wing portion includes a wing lateral edge spaced apart from the main body and having a front end and a rear end, a front curved edge connected between the front end of the wing lateral edge and a corresponding one of the two opposite ends of the front convex portion, and a rear mating edge connected between the rear end of the wing lateral edge and a corresponding one of the two opposite ends of the rear concave portion. The front curved edges of the wing portions are connected to a periphery of the front convex portion of the main body, the wing lateral edges of the wing portions are connected to each other, and the rear mating edges of the wing portions are connected to each other to thereby form the sleeve body. The first adhesive layer is fixed between an inner surface of the upper and an outer surface of the sleeve body.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
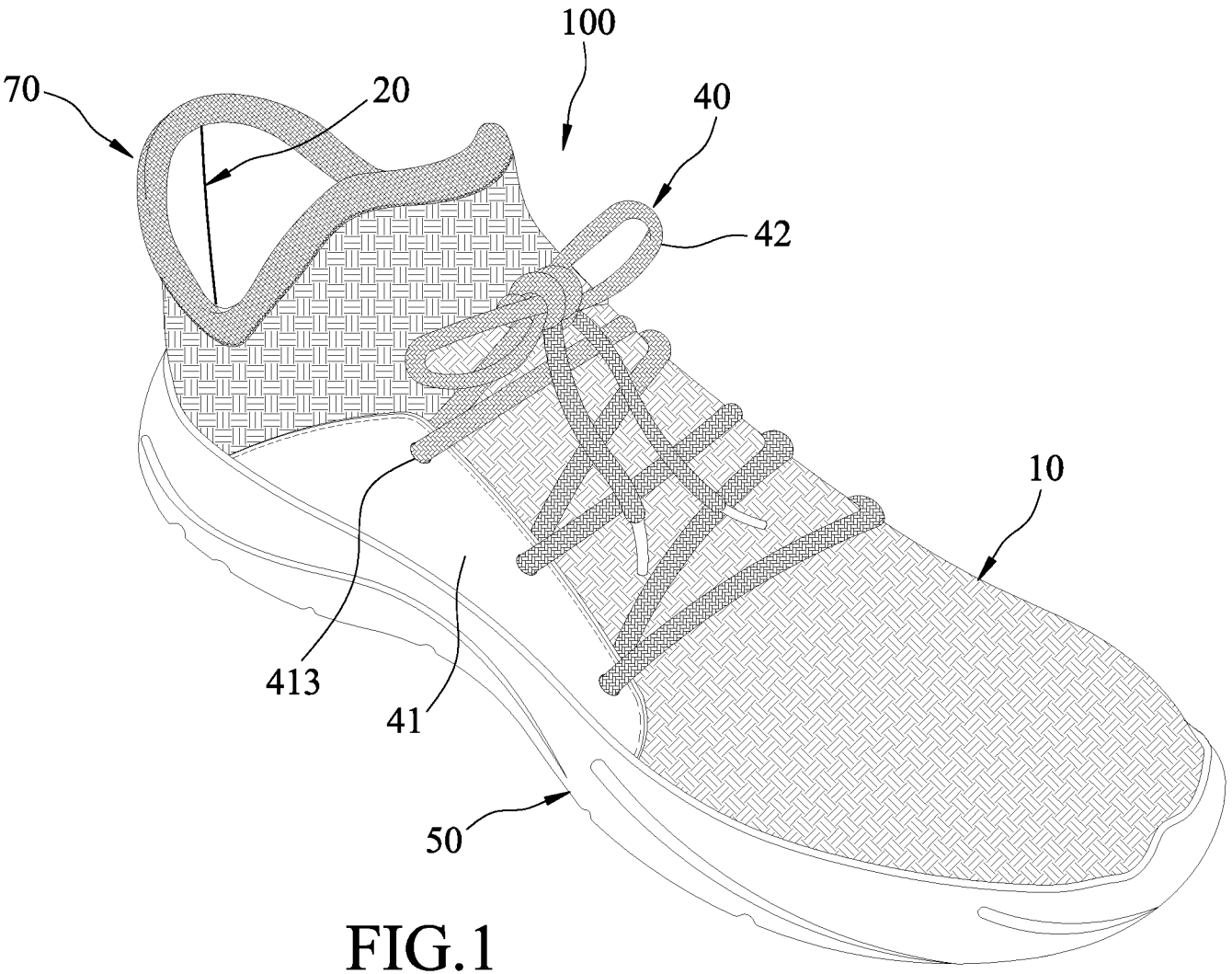
FIG. 1 is a perspective view of a moisture-permeable waterproof shoe according to an embodiment of the present disclosure.

Referring to FIGS. 1 to 4, a moisture-permeable waterproof shoe 100 according to an embodiment of the present disclosure is shown to comprise an upper 10, a shoe-shaped inner sleeve 20, a first adhesive layer 30, a tightening unit 40, a sole 50, a second adhesive layer 60 and a connecting band 70.

The upper 10 defines an interior space 12, and has a top open end 11 communicating with the interior space 12. In this embodiment, the upper 10 is in the form of a sock, but is not limited thereto.

The shoe-shaped inner sleeve 20 is inserted into the interior space 12 of the upper 10 through the top open end 11, and includes a sleeve body 21 and a waterproof unit 22. The sleeve body 21 defines a foot space 26 for receiving a user's foot (not shown), and has a top open end 25 communicating with the foot space 26 for entry of the user's foot thereinto and corresponding to the top open end 11 of the upper 10.

Figure 4:
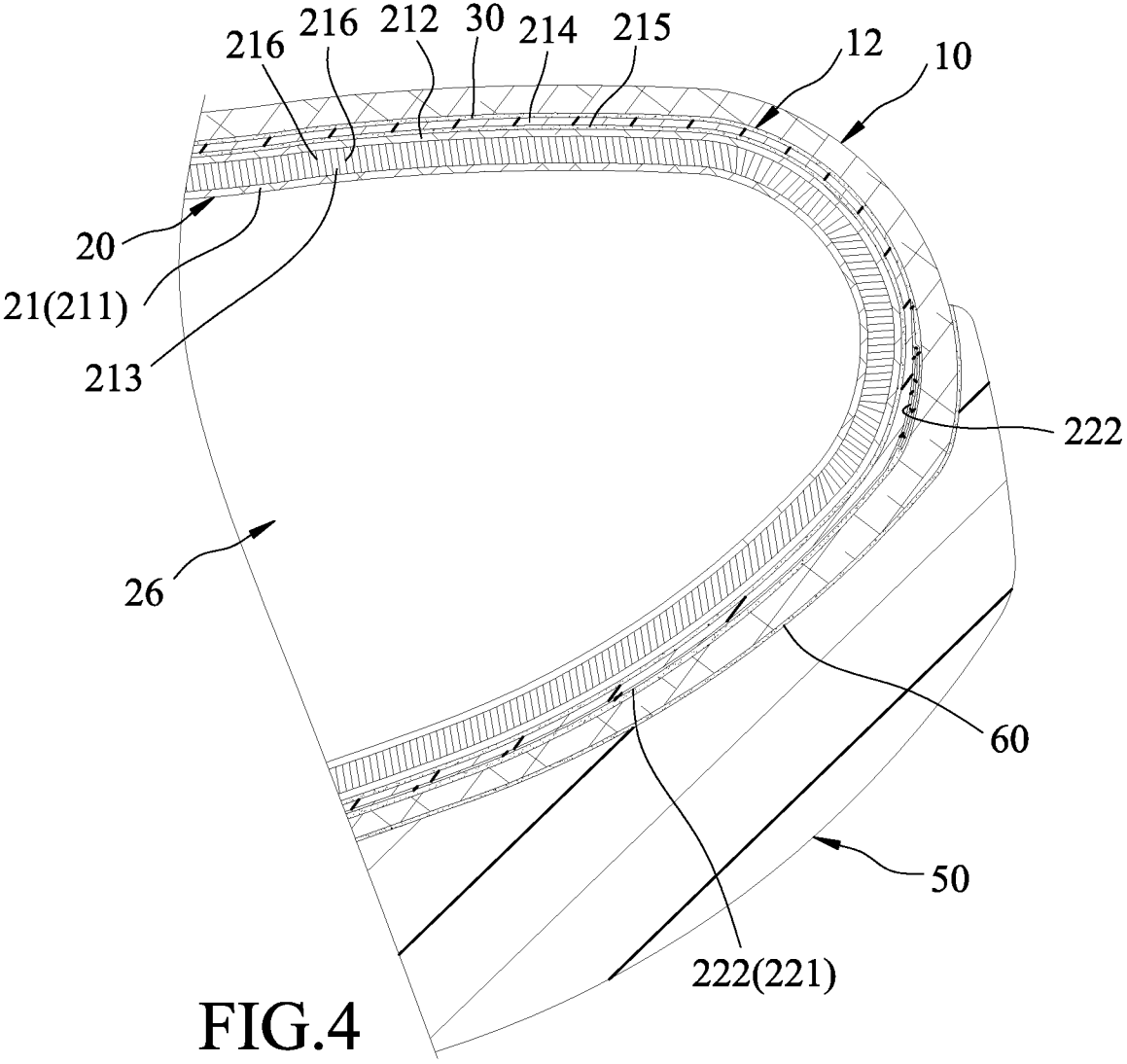
FIG. 4 is an enlarged fragmentary sectional view of FIG. 3.
Figure 5:
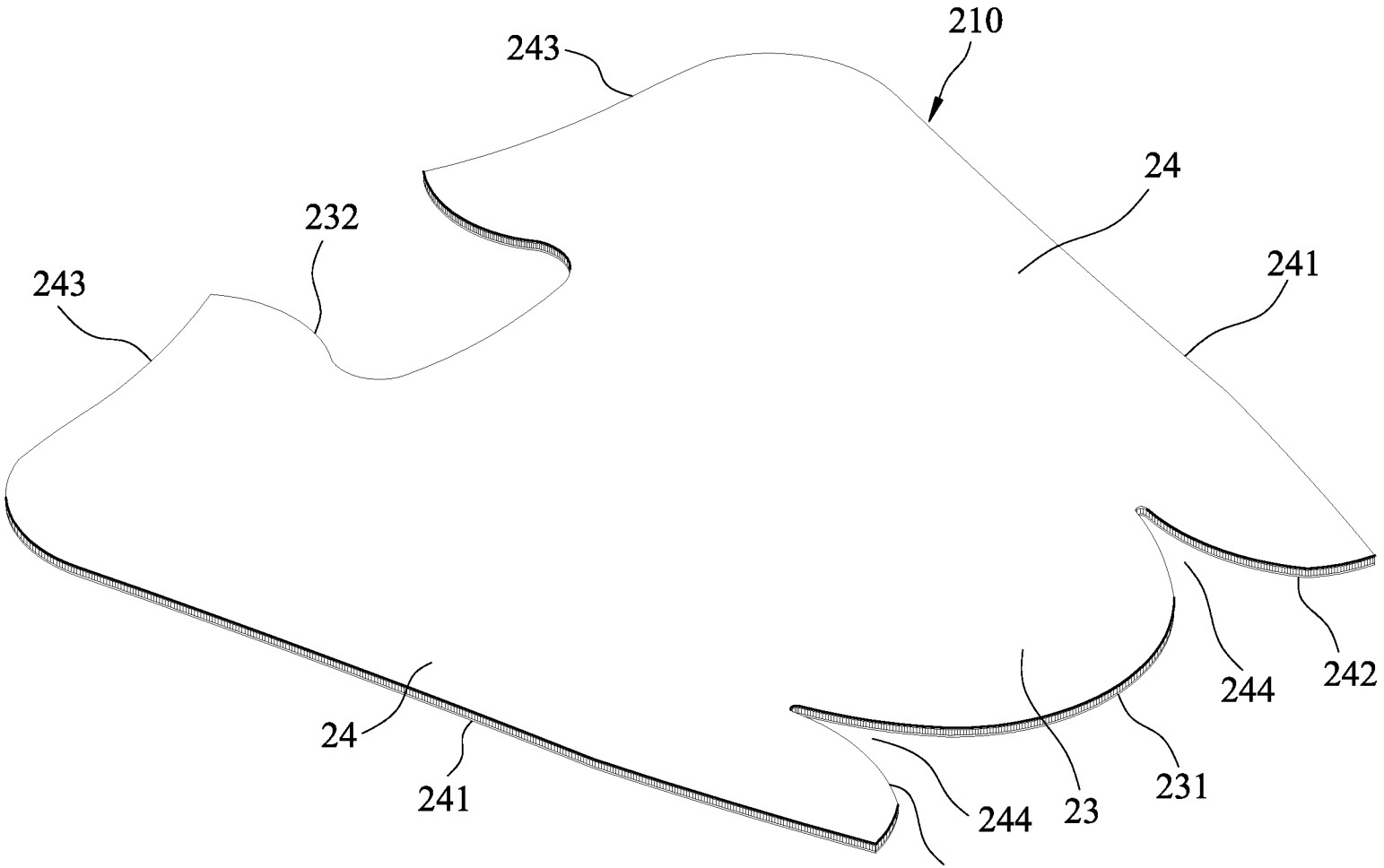
FIG. 5 is a perspective view of a cut piece for making a sleeve body of a shoe-shaped inner sleeve of the embodiment.

Referring to FIG. 5, in combination with FIG. 4, the sleeve body 21 is made from a cut piece 210 which includes a fabric lining layer 211, an outer fabric layer 212, an upright velvet layer 213, a moisture-permeable waterproof layer 214, and a bonding layer 215. The upright velvet layer 213 has a plurality of spaced-apart pile yarns 216 woven between the fabric lining layer 211 and the outer fabric layer 212. The moisture-permeable waterproof layer 214 is located on an outer surface of the outer fabric layer 212. The bonding layer 215 is fixed between the outer fabric layer 212 and the moisture-permeable waterproof layer 214. In this embodiment, the fabric lining layer 211 serves as an inner surface of the sleeve body 21 and is configured to contact the user's foot when the user's foot is inserted into the foot space 26, while the moisture-permeable waterproof layer 214 serves as an outer surface of the sleeve body 21. Further, the bonding layer 215 is an adhesive layer.

In this embodiment, the moisture-permeable waterproof layer 214 is made of polyurethane (PU), but is not limited thereto. In other embodiment, the moisture-permeable waterproof layer 214 may be made of thermoplastic polyurethane (TPU), polyethylene (PE), polytetrafluoroethylene (PTFE), polypropylene (PP) or thermoplastic polyester elastomer (TPEE). Moreover, the moisture-permeable waterproof layer 214 has a water resistance that is not less than hydrostatic pressure of 3000 mm $H_2O$ under the waterproof standard test method of Japanese JISL1092B, and a moisture permeability that is not less than 3000 $g/m^2/24$ hr under the hygroscopic standard test method of Japanese JIS L1099B1. Thus, the moisture-permeable waterproof layer 214 has waterproof and moisture-permeable effect.

Figure 6:
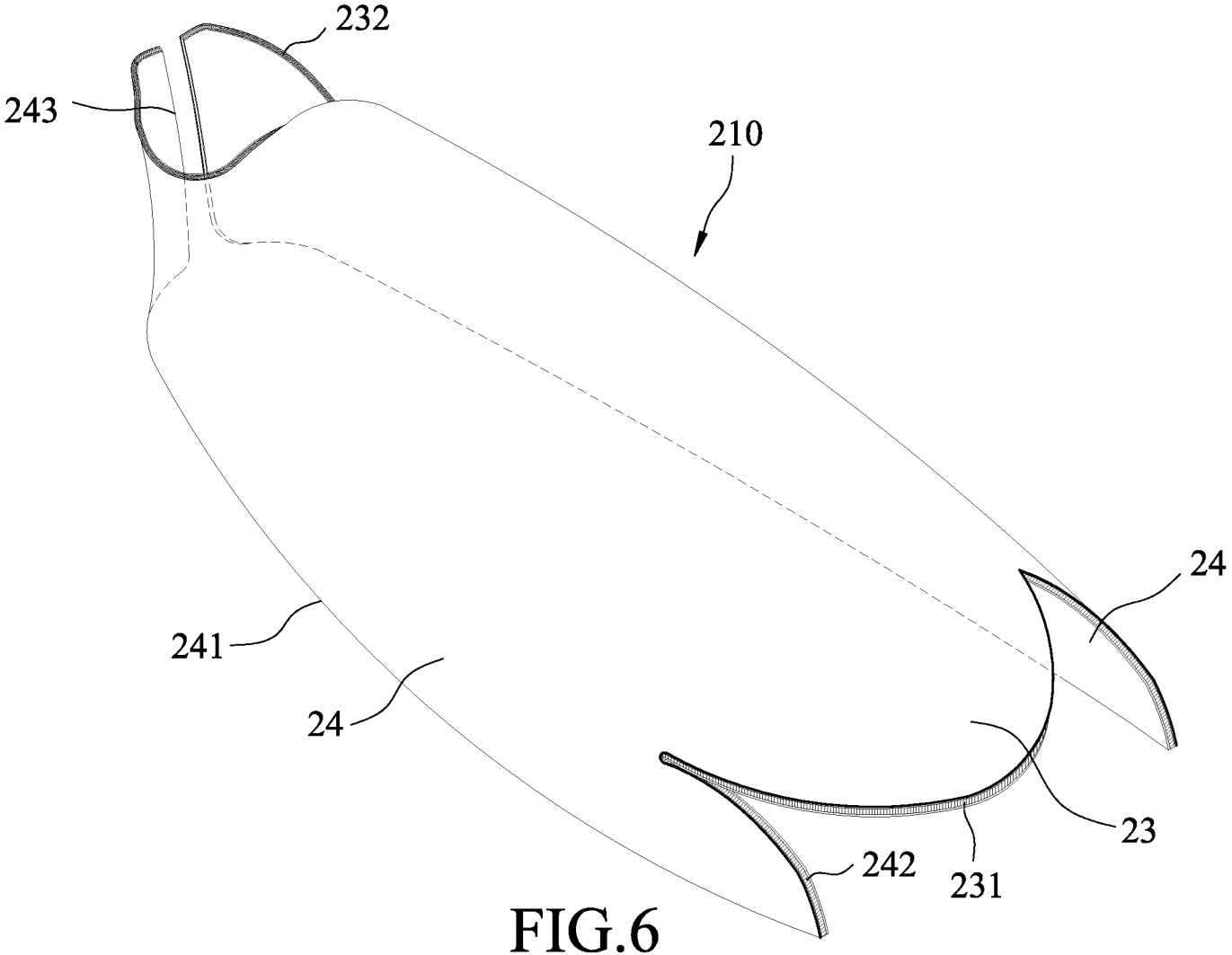
FIG. 6 illustrates how the cut piece can be folded to form the sleeve body of the inner sleeve of the embodiment.

Referring to FIG. 6, in combination with FIG. 5, the cut piece 210 has a main body 23, and two wing portions 24 symmetrically disposed on two opposite sides of the main body 23 and integrally connected as one piece with the main body 23. The main body 23 has a front convex portion 231 and a rear concave portion 232 opposite to the front convex portion 231. Each of the front convex portion 231 and the rear concave portion 232 has two opposite ends.

Each wing portion 24 includes a wing lateral edge 241 spaced apart from the main body 23 and having a front end and a rear end, a front curved edge 242 connected between the front end of the wing lateral edge 241 and a corresponding one of the opposite ends of the front convex portion 231, and a rear mating edge 243 connected between the rear end of the wing lateral edge 241 and a corresponding one of the opposite ends of the rear concave portion 232. The front curved edge 242 of each wing portion 24 and the corresponding end of the front convex portion 231 is formed with a groove 244 therebetween.

Figure 7:
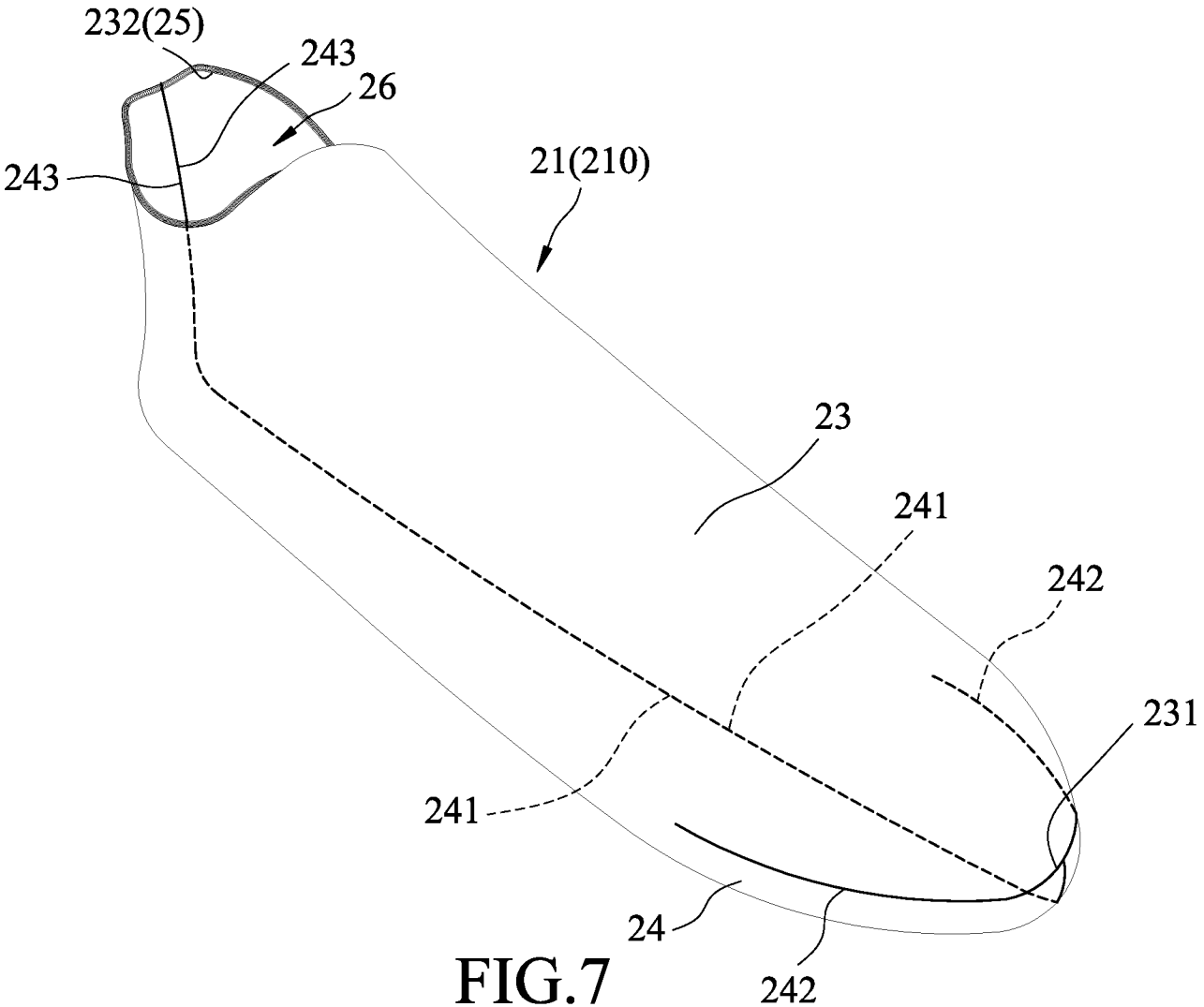
FIG. 7 illustrates how the cut piece is sewn to form the sleeve body of the inner sleeve of the embodiment.
Figure 8:
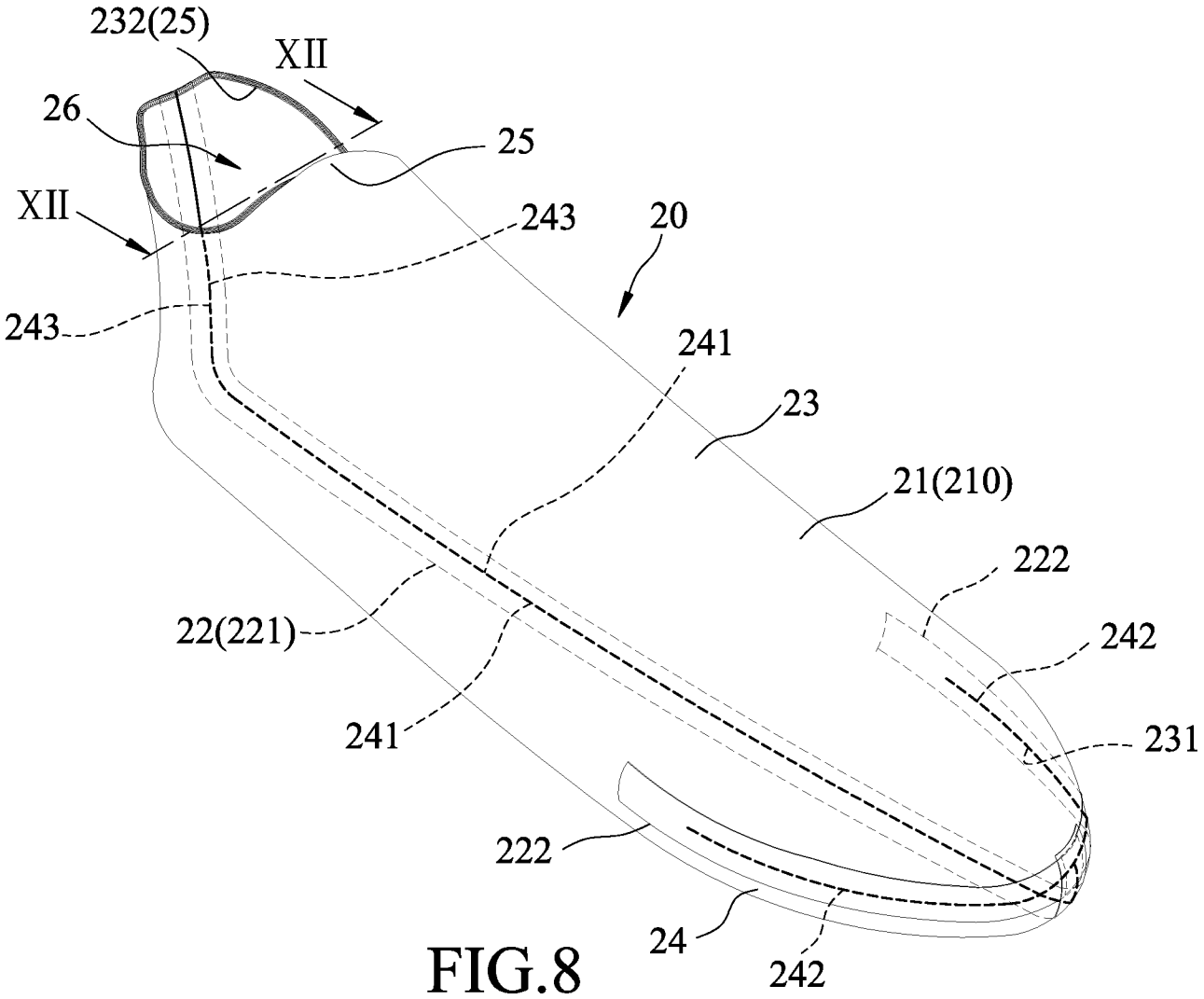
FIG. 8 is a view similar to FIG. 7, but illustrating how a waterproof unit of the inner sleeve covers the seams of the sleeve body.
Figure 12:
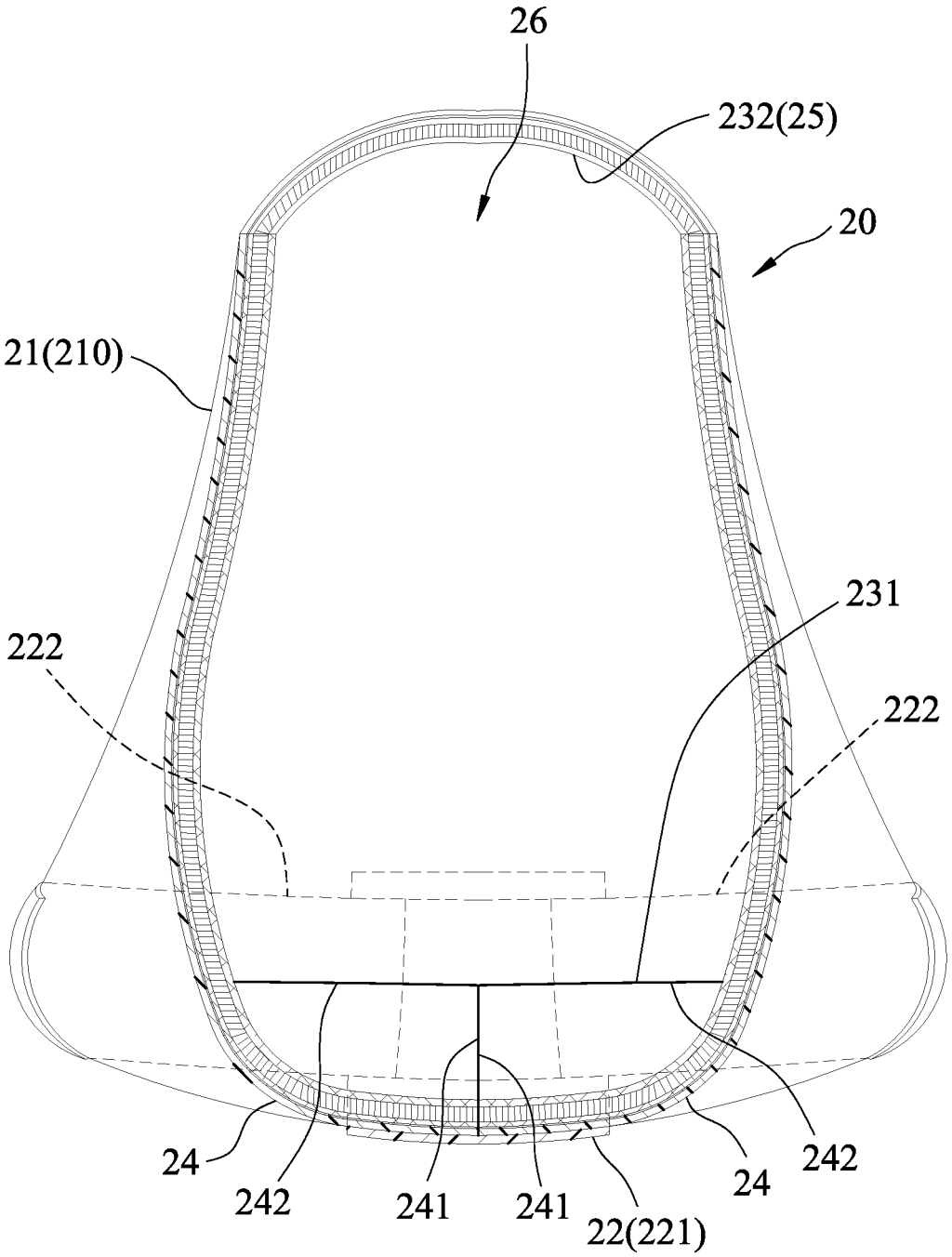
FIG. 12 is a sectional view taken along line XII-XII of FIG. 8.

Referring to FIGS. 7 and 8, in combination with FIG. 6, the front curved edges 242 of the wing portions 24 are connected to a periphery of the front convex portion 231 of the main body 23 by sewing, the wing lateral edges 241 of the wing portions 24 are connected to each other by sewing, and the rear mating edges 243 of the wing portions 24 are also connected to each other by sewing, thereby forming the sleeve body 21. The top open end 25 of the sleeve body 21 is defined by the rear concave portion 232 when the rear mating edges 243 of the wing portions 24 are connected to each other. In this embodiment, the front curved edge 242 of each wing portion 24 has an arc length substantially equal to one half of an arc length of the front convex portion 231. Further, the front convex portion 231 of the main body 23 and the front curved edges 242 of the wing portions 24 are located on a front end of the sleeve body 21, the rear mating edges 243 of the wing portions 24 are located on a rear end of the sleeve body 21, and the wing lateral edges 241 of the wing portions 24 are located on a bottom end of the sleeve body 21. Through this, as shown in FIG. 12, the inner surface of the sleeve body 21 corresponding to the instep of the user will have no seams, thereby presenting a completely smooth surface.

With reference to FIG. 8, the waterproof unit 22 is fixedly connected to the moisture-permeable waterproof layer 214 opposite to the outer fabric layer 212, and covers the moisture-permeable waterproof layer 214 at positions corresponding to the junction of the front curved edges 242 and the periphery of the front convex portion 231, the junction of the wing lateral edges 241, and the junction of the rear mating edges 243.

The waterproof unit 22 includes a first waterproof strip 221 and two second waterproof strips 222. The first waterproof strip 221 extends from the front end to the rear end of the sleeve body 21, and is fixedly connected to and covers the moisture-permeable waterproof layer or outer surface 214 of the sleeve body 21 at a position corresponding to the junction of the wing lateral edges 241 and the junction of the rear mating edges 243 of the wing portions 21.

Figure 9:
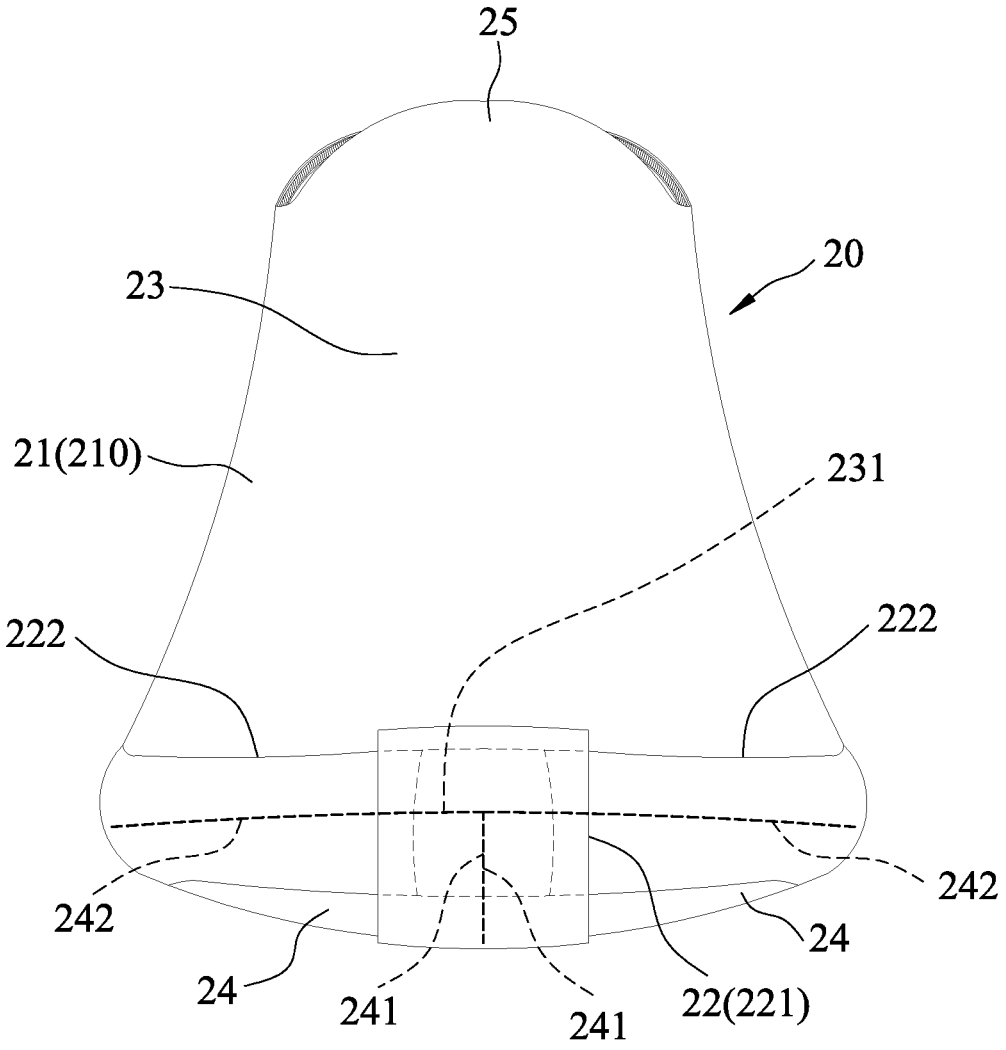
FIG. 9 is a front view of the inner sleeve of FIG. 8.
Figure 10:
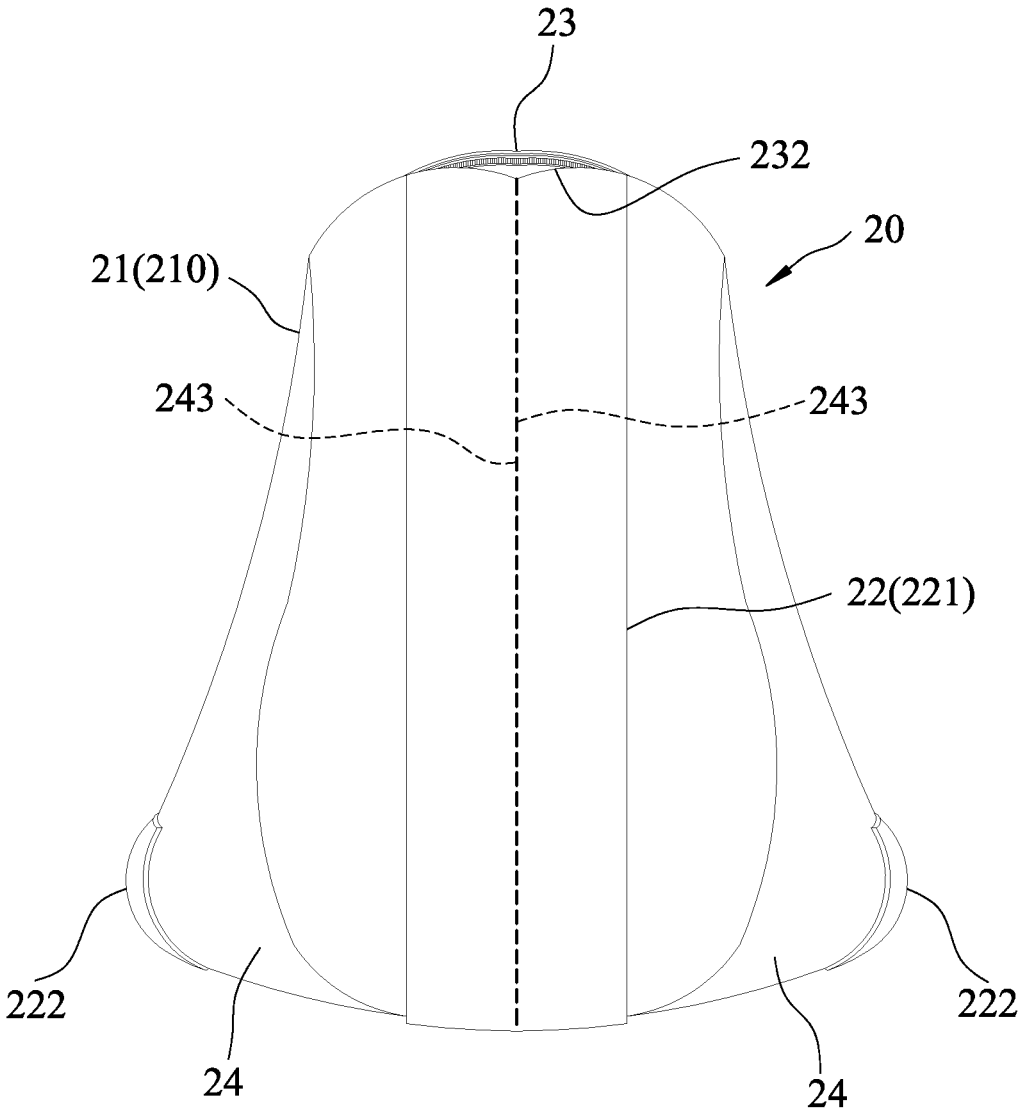
FIG. 10 is a rear view of the inner sleeve of FIG. 8.
Figure 11:
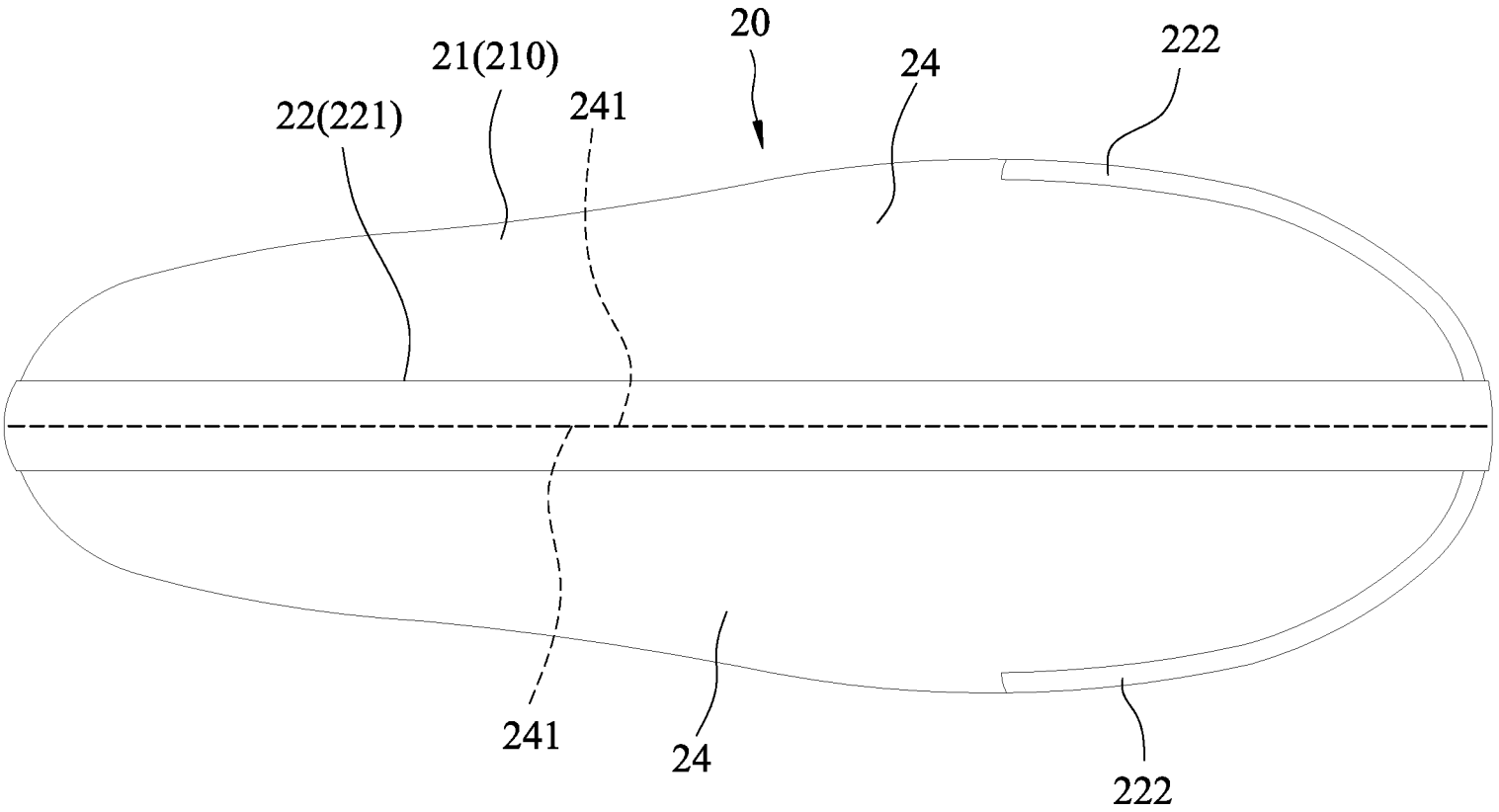
FIG. 11 is a bottom view of the inner sleeve of FIG. 8.

Each second waterproof strip 222 is fixedly connected to and covers the outer surface 214 of the sleeve body 21 at a position corresponding to the junction of the front curved edge 242 of each wing portion 24 and the periphery of the front convex portion 231, as shown in FIGS. 8, 9 and 11. The second waterproof strips 222 interlace with a front end of the first waterproof strip 221.

Figure 3:
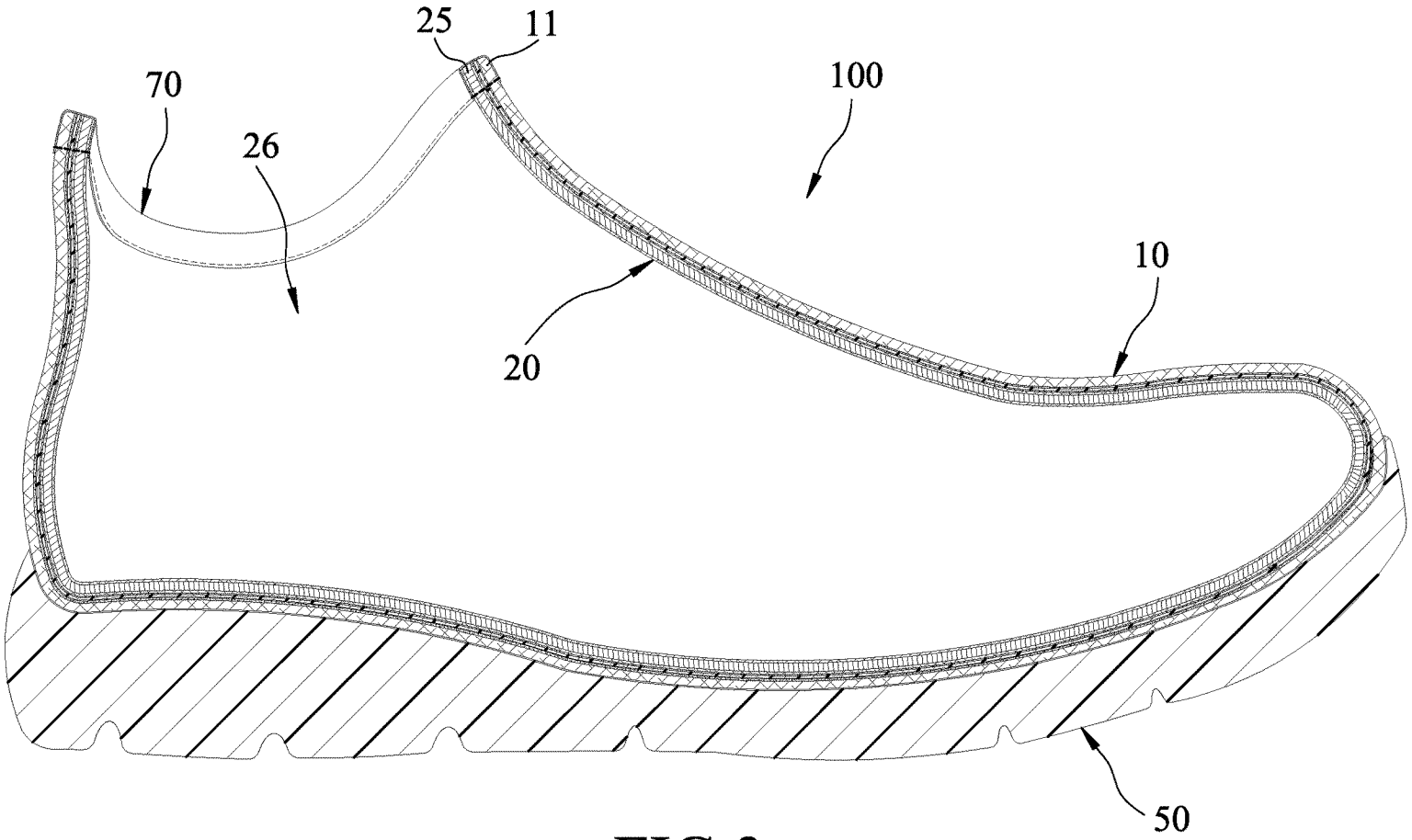
FIG. 3 is an assembled sectional view of the embodiment.

With reference to FIGS. 3 and 4, the first adhesive layer 30 is fixedly connected between an inner surface of the upper 10 and the outer surface 214 of the sleeve body 21, so that the upper 10 and the inner sleeve 20 are abuttingly adhered to each other.

Figure 2:
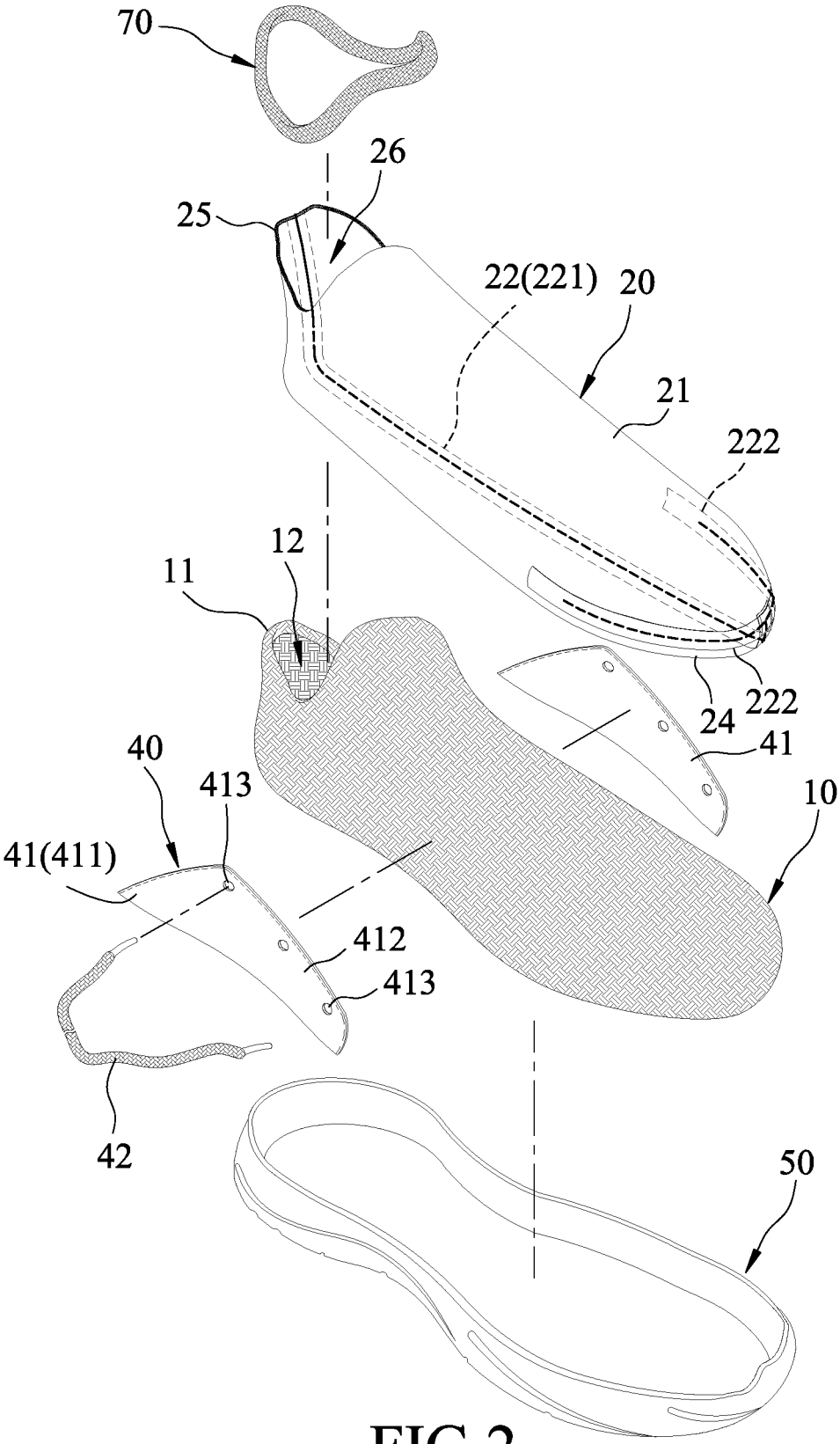
FIG. 2 is an exploded perspective view of the embodiment.

With reference to FIGS. 1 and 2, the tightening unit 40 includes two decorative tightening plates 41 symmetrically disposed on and abutting against left and right sides of the upper 10 and connected to the sole 50, and a tightening strap 42 interconnecting the decorative tightening plates 41. Each decorative tightening plate 41 has a bottom end portion 411 connected to the sole 50, and a top end portion 412 connected to the tightening strap 42. In this embodiment, the top end portion 412 is formed with a plurality of spaced-apart through holes 413. The tightening strap 2 is a shoelace that is removably threaded through the through holes 413 in the tightening plates 41.

Referring again to FIGS. 3 and 4, the sole 50 is fixed to a bottom portion of the upper 10. The second adhesive layer 60 is used to fix a top portion of the sole 50 to the bottom portion of the upper 10.

Referring again to FIGS. 1 and 2, the connecting band 70 is fixed to and surrounds the top open end 11 of the upper 10 and the top open end 25 of the sleeve body 21.

With reference to FIGS. 2 to 4, a method for making the moisture-permeable waterproof shoe 100 is briefly described below, but is not limited thereto.

The first step is to adhere a moisture-permeable waterproof membrane (not shown) on an outer surface of a fabric material (not shown) having a three-layer structure using an adhesive.

The second step is to cut the fabric material to obtain the cut piece 210 (see FIG. 5).

The third step is to form the cut piece 210 into the sleeve body 21 (see FIG. 7) of the inner sleeve 20 having a three-dimensional shape by sewing.

The fourth step is to adhere the first waterproof strip 221 (see FIG. 8) and the second waterproof strips 222 (see FIG. 8) to the seams of the sleeve body 21 so as to form the waterproof and breathable shoe-shaped inner sleeve 20.

The fifth step is to sleeve the inner sleeve 20 on a shoe last (not shown).

The sixth step is to spray adhesive on the inner surface of the upper 10, after which the upper 10 is sleeved on an assembly of the shoe last and the inner sleeve 20.

The seventh step is to heat an assembly of the shoe last, the inner sleeve 20 and the upper 10 so as to adhere together the upper 10 and the inner sleeve 20.

The eighth step is to connect the decorative tightening plates 41 and the sole 50 to the upper 10 using adhesives, after which they are heated and pressurized.

Finally, the ninth step is to remove the shoe last.

The making of the moisture-permeable waterproof shoe 100 is thus completed.

From the foregoing, the advantages of this disclosure can be summarized as follows:

1) The elasticity of the upright velvet layer 213 of the sleeve body 21 is better in comparison with the prior art, so that it can facilitate smooth inserting of the user's foot into the foot space 26 when wearing the shoe 100.

2) The breathability of the upright velvet layer 213 of the sleeve body 21 is also better in comparison with the prior art, so that it can effectively improve the comfort of wearing the shoe 100.

3) The pile yarns 216 of the upright velvet layer 213 of the sleeve body 21 are woven between the fabric lining layer 211 and the outer fabric layer 212 to form an integrated structure with the same. Hence, in comparison with the prior art, the upright velvet layer 213 cannot be easily peeled off from the fabric lining layer 211 and the outer fabric layer 212.

Figure 13:
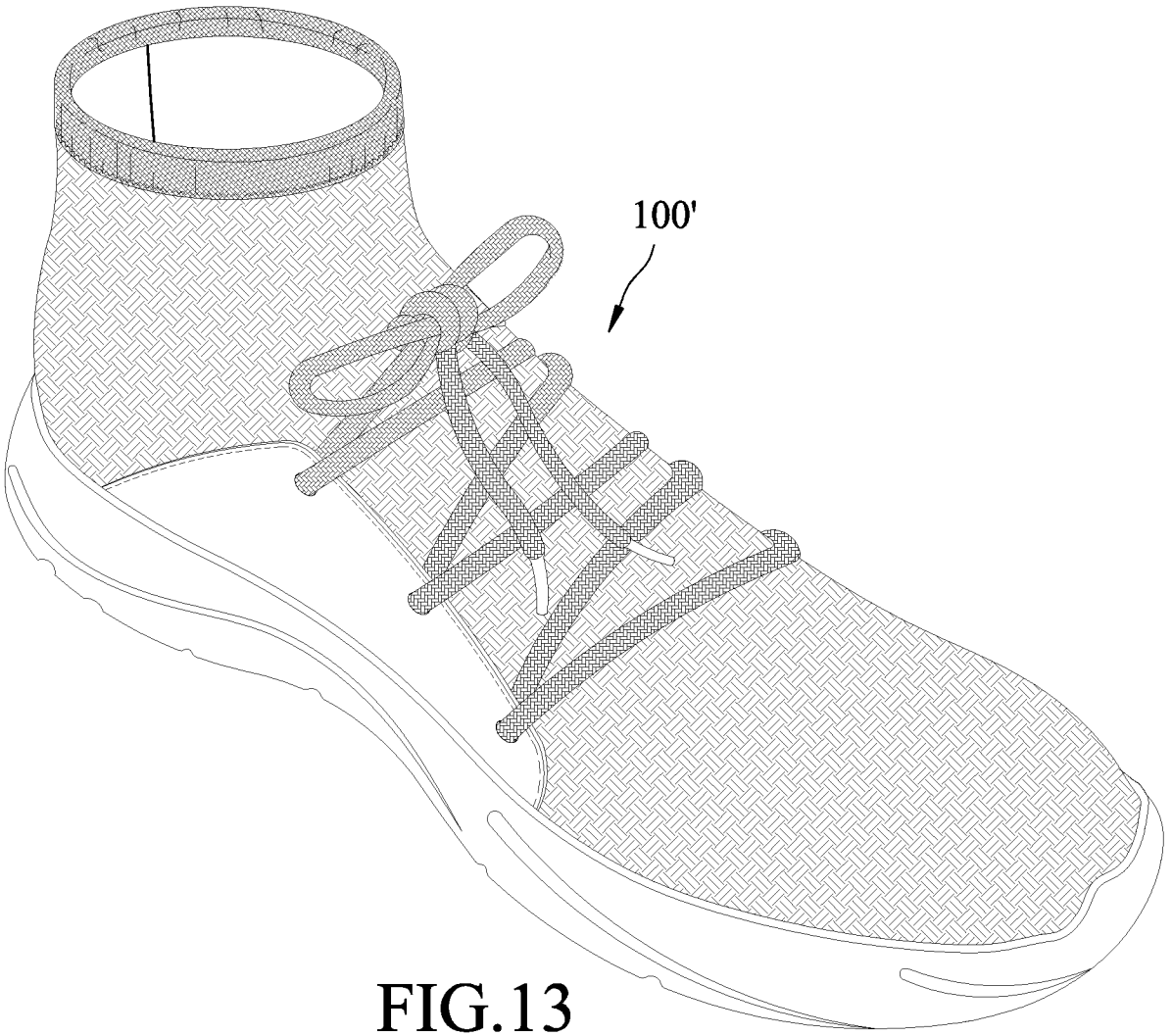
FIG. 13 is a perspective view of an alternative form of the moisture-permeable waterproof shoe of the embodiment.

FIG. 13 illustrates an alternative form of the embodiment. In this case, the moisture-permeable waterproof shoe 100' is a high-top shoe.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A moisture-permeable waterproof shoe comprising:

an upper defining an interior space;

a shoe-shaped inner sleeve inserted into said interior space, and including a sleeve body that defines a foot space for receiving a user's foot and that is made from a cut piece which includes a fabric lining layer, an outer fabric layer and an upright velvet layer, said upright velvet layer having a plurality of spaced-apart pile yarns woven between said fabric lining layer and said outer fabric layer, said cut piece having a main body, and two wing portions symmetrically disposed on two opposite sides of said main body and integrally connected as one piece with said main body, said main body having a front convex portion and a rear concave portion opposite to said front convex portion, each of said front convex portion and said rear concave portion having two opposite ends, each of said wing portions including a wing lateral edge spaced apart from said main body and having a front end and a rear end, a front curved edge connected between said front end of said wing lateral edge and a corresponding one of said two opposite ends of said front convex portion, and a rear mating edge connected between said rear end of said wing lateral edge and a corresponding one of said two opposite ends of said rear concave portion, wherein said front curved edges of said wing portions are connected to a periphery of said front convex portion of said main body, said wing lateral edges of said wing portions are connected to each other, and said rear mating edges of said wing portions are connected to each other to thereby form said sleeve body;

a first adhesive layer fixed between an inner surface of said upper and an outer surface of said sleeve body; and a sole fixed to a bottom portion of said upper.

2. The moisture-permeable waterproof shoe as claimed in claim 1, wherein said shoe-shaped inner sleeve further includes a waterproof unit, said cut piece further including a moisture-permeable waterproof layer located on an outer surface of said outer fabric layer, and a bonding layer fixed between said outer fabric layer and said moisture-permeable waterproof layer, said waterproof unit being fixedly connected to said moisture-permeable waterproof layer opposite to said outer fabric layer and covering said moisture-permeable waterproof layer at positions corresponding to the junction of said front curved edges and said periphery of said front convex portion, the junction of said wing lateral edges, and the junction of said rear mating edges.

3. The moisture-permeable waterproof shoe as claimed in claim 2, wherein said waterproof unit includes a first waterproof strip and two second waterproof strips, said moisture-permeable waterproof layer serving as the outer surface of said sleeve body, said first waterproof strip extending from a front end to a rear end of said sleeve body and being fixedly connected to and covering said outer surface of said sleeve body at a position corresponding to the junction of said wing lateral edges and said junction of said rear mating edges, each of said second waterproof strips being fixedly connected to and covering said outer surface of said sleeve body at a position corresponding to the junction of said front curved edge of each of said wing portions and said periphery of said front convex portion, said second waterproof strips interlacing with a front end of said first waterproof strip.

4. The moisture-permeable waterproof shoe as claimed in claim 1, wherein said front curved edge of each of said wing portions has an arc length substantially equal to one half of an arc length of said front convex portion.

5. The moisture-permeable waterproof shoe as claimed in claim 1, wherein said front convex portion of said main body and said front curved edges of said wing portions are located on a front end of said sleeve body, said rear mating edges of said wing portions are located on a rear end of said sleeve body, and said wing lateral edges of said wing portions are located on a bottom end of said sleeve body.

6. The moisture-permeable waterproof shoe as claimed in claim 1, wherein said front curved edge of each of said wing portions and the corresponding one of said two opposite ends of said front convex portion of said main body is formed with a groove therebetween.

7. The moisture-permeable waterproof shoe as claimed in claim 1, further comprising a tightening unit which includes two decorative tightening plates symmetrically disposed on left and right sides of said upper and connected to said sole, and at least one tightening strap interconnecting said decorative tightening plates, each of said decorative tightening plates having a bottom end portion connected to said sole, and a top end portion connected to said at least one tightening strap.

8. The moisture-permeable waterproof shoe as claimed in claim 7, wherein said top end portion of each of said decorative tightening plates is formed with a plurality of spaced-apart through holes, and said at least one tightening strap is a shoelace that is removably threaded through said through holes in said tightening plates.

9. The moisture-permeable waterproof shoe as claimed in claim 1, further comprising a connecting band, said upper having a top open end communicating with said interior space, said shoe-shaped inner sleeve being inserted into said interior space through said top open end, said sleeve body having a top open end communicating with said foot space and corresponding to said top open end of said upper, said connecting band being fixed to and surrounding said top open end of said upper and said top open end of said sleeve body.

10. The moisture-permeable waterproof shoe as claimed in claim 1, further comprising a second adhesive layer for fixing said sole to said bottom portion of said upper.

* * * * *